US009604353B1

(12) United States Patent
Ralph

(10) Patent No.: US 9,604,353 B1
(45) Date of Patent: Mar. 28, 2017

(54) NAIL REMOVAL TOOL

(71) Applicant: Gregory W. Ralph, Fairview, PA (US)

(72) Inventor: Gregory W. Ralph, Fairview, PA (US)

( * ) Notice: Subject to any disclaimer, the term of this patent is extended or adjusted under 35 U.S.C. 154(b) by 0 days.

(21) Appl. No.: 14/863,919

(22) Filed: Sep. 24, 2015

(51) Int. Cl.
*B25C 11/00* (2006.01)
*B25F 3/00* (2006.01)

(52) U.S. Cl.
CPC ..... *B25C 11/00* (2013.01); *B25F 3/00* (2013.01)

(58) Field of Classification Search
CPC ..... B25C 11/00; B25C 11/02; B25C 13/00; B25B 27/02; B25B 27/14; B23P 19/04
USPC ..... 254/20
See application file for complete search history.

(56) References Cited

U.S. PATENT DOCUMENTS 33,218 A * 9/1861 Dixon ..... B25C 11/00 254/20
401,113 A * 4/1889 Baumeister ..... B25C 11/00 254/20
2,796,232 A * 6/1957 Steffanus ..... B25C 11/00 12/16
2,900,169 A * 8/1959 White ..... B25B 27/023 254/20
3,735,650 A * 5/1973 Weng, Jr. ..... B25B 27/18 81/53.2
3,750,500 A * 8/1973 Peterson ..... B25D 1/16 254/18
4,078,766 A * 3/1978 Saurwein ..... B25C 11/02 254/18
5,141,205 A * 8/1992 Iwai ..... B25C 11/00 254/18
5,680,800 A * 10/1997 Sharpe ..... B25B 23/0021 81/177.2
6,755,392 B1 * 6/2004 Phillips ..... B25C 11/00 254/18
8,341,818 B1 * 1/2013 Ralph ..... B25F 3/00 254/19
2009/0236572 A1 * 9/2009 Laun ..... B25C 11/02 254/18
2013/0032769 A1 * 2/2013 Kittell ..... B25C 11/00 254/18

* cited by examiner

*Primary Examiner* — Larry E Waggle, Jr.
*Assistant Examiner* — Tyrone V Hall, Jr.
(74) *Attorney, Agent, or Firm* — Richard K Thomson

(57) ABSTRACT

A nail removal tool in the form of an adapter for attachment to the drive socket of a rotary driver such as a rotary pneumatic impact driver. The adapter includes a drive shaft engagable with the chuck of the pneumatic driver, a cylindrical bit with a slot for receiving the body of a nail and a ramp for engaging under the head and lifting it to dislodge the nail from its embedded location. Slop between the drive blade and the slot in the cylindrical bit serves as a flexible connection to provide proper presentation of cylindrical bit allowing wedging of the adapter beneath the head of a nail which is reluctant to be removed.

6 Claims, 2 Drawing Sheets

NAIL REMOVAL TOOL

BACKGROUND AND SUMMARY OF THE INVENTION

The present invention is directed to the construction industry. More particularly, the present invention is directed to a nail removal tool in the form of an adapter securable to a rotary power tool, such as a rotary pneumatic impact drive motor.

When re-roofing, one of the most difficult, time-consuming tasks is removing the nails used to secure the old shingles. If these nails are not removed, they can tear through the new shingles and interfere with their proper installation and functionality. In addition, they pose a safety hazard to the installers as they move about the roof. It is among the objects of the present invention to provide an effective, yet inexpensive, adapter to remove the old nails.

In Applicant's earlier disclosure, issued as U.S. Pat. No. 8,341,818 issued Jan. 1, 2013, a coil spring was utilized to accommodate the force applied by the tool so as not to rip the head off the nail nor damage the drive. It was found that the "slop" in the interconnections in the adapter is adequate to accomplish a complete removal of the nail without damaging the drive.

The adapter for a rotary power tool for removing nails of the present invention comprises a) a drive shaft engagable with a chuck of the rotary power tool, the drive shaft having a diametrically extending drive blade; b) a cylindrical bit having a diametrically extending recess which receives the drive blade of the drive shaft, the cylindrical bit having a foot with a slot for receiving a body portion of a nail, the foot having a ramp extending on at least one side of the slot for engaging beneath a head of the nail; c) flexible connection means attached between the drive shaft and the cylindrical bit permitting the cylindrical bit to float relative to the drive shaft.

More preferably, the ramp extending on at least one side of the slot for engaging beneath a head of the nail extends on both sides of the slot. The flexible connection means comprises slop between the drive and the cylindrical bit created by the recess having a larger thickness than the drive blade. The drive blade has a hole therethrough; the cylindrical bit has a pair of aligned holes; and a pin extends through the pair of aligned holes and the hole in the drive blade to secure the cylindrical bit to the drive blade. The distal end of the pin has a hole therethrough that receives a cotter pin. The upper central rotational axis of the cylindrical bit is radially offset from rotational axis of the foot.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
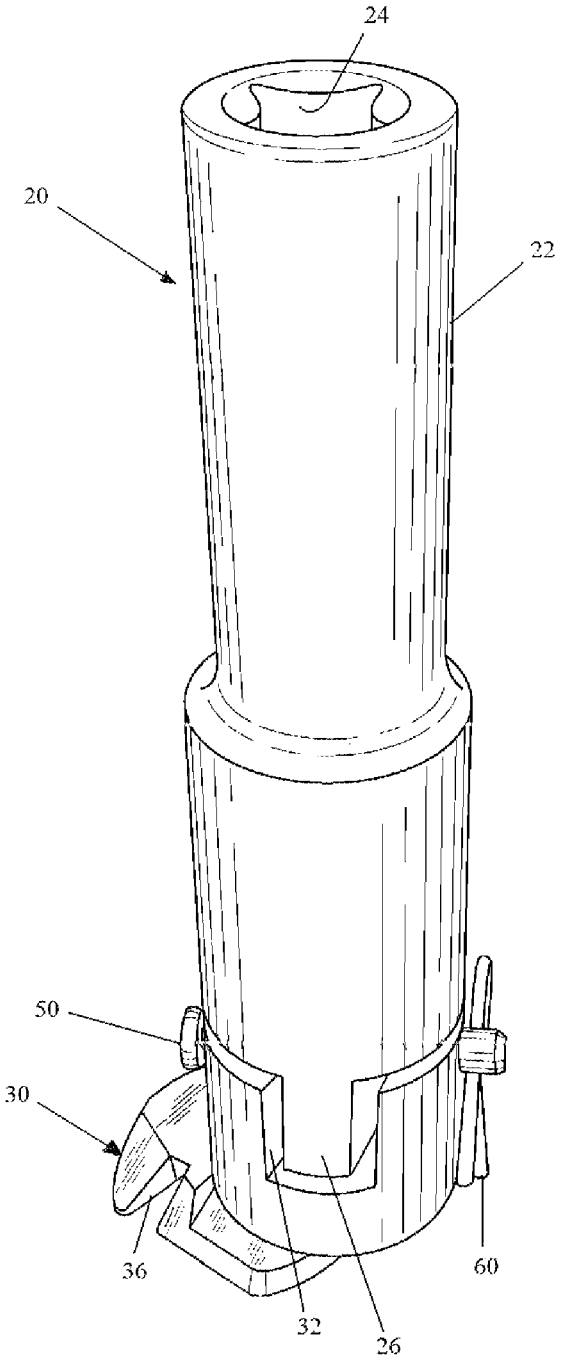
FIG. 1 is a perspective front view of a first embodiment of the nail removal tool of the present invention.
Figure 2:
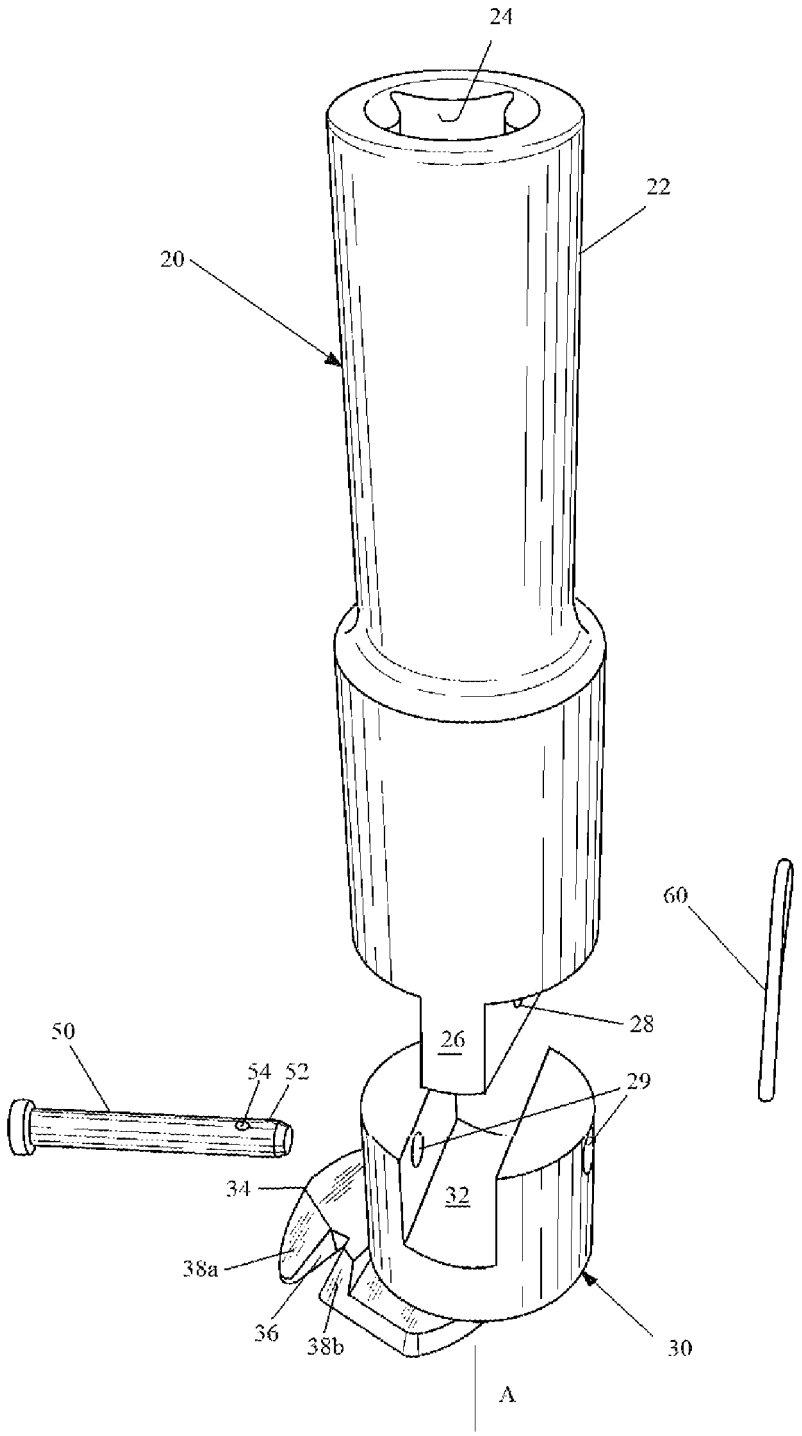
FIG. 2 is an exploded front perspective view of the first embodiment.

A first embodiment of the nail removal tool of the present invention is depicted in FIGS. 1 and 2 generally at 20. As best seen in FIG. 2, nail removal tool 20 comprises an adapter for a rotary power tool such as a rotary pneumatic impact driver and includes a drive shaft 22 engagable with a chuck of the rotary power tool (not shown). Drive shaft 22 has an internal recess 24 depicted here as being square, since that is the normal configuration of the male protrusion which it engages. It will be understood that other shapes are within the scope of the present invention. Drive shaft 22 has a diametrically extending drive blade 26 depicted as a conventional straight blade, although here, again, other shapes are within the scope of this invention.

Cylindrical bit 30 has a diametrically extending recess 32 which receives drive blade 26 drive shaft 22. Cylindrical bit 30 has an upper cylindrical portion 33 with a lower foot 34. Foot 34 has a slot 36 for receiving a body portion of a nail (not shown). Foot 34 has a ramp 38*a* extending on at least one side (and preferably both sides, see 38*b*) of slot 36 for engaging beneath a head of the nail and dislodging it from its hole in the roofing panel.

Flexible connection means is used to attached drive shaft 22 and cylindrical bit 30 to cushion the force transmitted by the rotary power tool to cylindrical bit 30. In this embodiment of the invention, the flexible connection means is formed by slop between the drive shaft 20 and cylindrical bit 30 resulting from the fact that diametrically extending recess 32 has a thickness that is larger than that of drive blade 26. Drive blade 26 has a laterally extending hole 28 which receives the shaft of a headed pin 50 which also extends through diametrically aligned holes 29 in cylindrical bit 30. Pin 50 has a hole 54 in end 52 which protrudes from holes 28 and aligned holes 29 and receives cotter pin 60 to retain it in engagement, cylindrical bit 30 to drive shaft 22.

Cylindrical bit 30 has a central rotational axis A (FIG. 2) and slot 36 in foot 34 is radially offset from axis A. As the rotary power tool with the adapter 20 attached thereto is manipulated to position the mouth of slot 36 adjacent the head of a nail to be removed, and, as impact air power energizes the bit, ramp surfaces 38*a*, 38*b* will engage beneath the head of the nail, lifting it upwardly. The continued rotation of cylindrical bit 30 by the power tool will hammer the nail from its embedded location and toss it aside. The flexible connection means (slop between drive blade 26 and cylindrical bit 30) permits cylindrical bit 30 to float relative to the drive shaft 22 for proper receiving position of lower foot 34 necessary for engaging the nail when adapter 20 is moved horizontally over an uneven panel surface or at an angle less than perpendicular to the nail candidate for extraction. Additionally, this flexible connection means cushions the force delivered by the impact driver to the cylindrical bit 30 lessening the possibility that adapter 20 will be broken during use.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. An adapter for a rotary power tool for removing nails, said adapter comprising:

a) a drive shaft engagable with a chuck of the rotary power tool, said drive shaft having a diametrically extending drive blade;

b) a cylindrical bit having a diametrically extending recess which receives said drive blade of said drive shaft, said cylindrical bit having a foot with a slot for receiving a body portion of a nail, said foot having a ramp extending on at least one side of said slot for engaging beneath a head of the nail;

c) flexible connection means attached between said drive shaft and said cylindrical bit permitting said cylindrical bit to float relative to said drive shaft, wherein said flexible connection means is accomplished by means of slop between said drive shaft and said cylindrical bit without interposing any separate spring therebetween.

2. The adapter of claim 1 wherein said ramp extending on at least one side of said slot for engaging beneath a head of the nail extends on both sides of said slot.

3. The adapter of claim 1 wherein said flexible connection means comprises slop between said drive and said cylindrical bit created by said recess having a larger thickness than said drive blade.

4. The adapter of claim 3 further comprising a hole in said drive blade, a pair of aligned holes in said cylindrical bit, and a pin extending through said pair of aligned holes and said hole in said drive blade to secure said cylindrical bit to said drive blade.

5. The adapter of claim 4 wherein said pin comprises a first attachment means further comprising a hole in a protruding end portion of said pin and a cotter pin insertable therethrough.

6. The adapter of claim 5 wherein said cylindrical bit comprises an upper portion having a central rotational axis, said slot of said foot being radially offset from said central rotational axis.

* * * * *